US005131253A

United States Patent [19]

Hopkins

[11] Patent Number: 5,131,253

[45] Date of Patent: Jul. 21, 1992

[54] CARBIDE MANDREL FOR MICRO EXTRUSION OF METALS

[76] Inventor: Duane A. Hopkins, 37081 Twin Ct., Sterling Heights, Mich. 48312

[21] Appl. No.: 596,965

[22] Filed: Oct. 15, 1990

[51] Int. Cl.[5] ..... B21C 25/04
[52] U.S. Cl. ..... 72/269
[58] Field of Search ..... 72/264, 269, 467; 76/DIG. 11

[56] References Cited

U.S. PATENT DOCUMENTS

| | | | |
|---|---|---|---|
| 1,989,948 | 2/1935 | Singer | 72/264 |
| 2,366,344 | 1/1945 | McFadden | 72/269 |
| 3,240,047 | 3/1966 | Long et al. | 72/269 |
| 3,541,831 | 11/1970 | Simonton | 72/273 |
| 4,169,366 | 10/1979 | Ames | 72/269 |
| 4,378,686 | 4/1983 | Pardoe | 72/262 |

FOREIGN PATENT DOCUMENTS

| | | | |
|---|---|---|---|
| 104412 | 4/1989 | Japan | 72/269 |
| 1468 | of 1874 | United Kingdom | 72/269 |

OTHER PUBLICATIONS

"Tool Design Tips for Cold Extrusion", *Machinery*, pub. on May 1968; pp. 104–110.

*Primary Examiner*—Robert L. Spruill
*Assistant Examiner*—D. M. Gurley
*Attorney, Agent, or Firm*—Remy J. VanOphem

[57] ABSTRACT

A carbide mandrel for an extrusion die apparatus having a holder portion, a mandrel portion and a tapered intermediate portion joining the mandrel portion with the holder portion. The holder portion has a pair of recessed longitudinal guideway provided in its opposite sides. The holder portion is received in a longitudinal mandrel slot of a retainer collar mountable to an extrusion die apparatus. A pair of opposing longitudinal ribs protruding from the facing sides of the mandrel slot permit the holder portion of the carbide mandrel to be slidably inserted into the mandrel slot of the retainer collar. The mandrel portion has a linear array of micro mandrel elements receivable in a rectangular die aperture. The carbide mandrel is made from sintered carbide material which has a softening temperature significantly higher than the temperatures experienced during the extrusion process and sufficient hardness to be practically wear resistant.

50 Claims, 2 Drawing Sheets

CARBIDE MANDREL FOR MICRO EXTRUSION OF METALS

BACKGROUND OF THE INVENTION

1. Field of the Invention

The invention is related to metal extrusion devices and in particular to a carbide mandrel for use in the extrusion of hollow thin walled articles.

2. Description of the Prior Art

Conventionally, the devices for the extrusion of hollow metal articles have steel mandrels directing the flow of the extruded metals to produce an internal cavity or a plurality of cavities. These steel mandrels as taught by Yamaguchi et al in U.S. Pat. No. 3,808,860; Lugosi, in U.S. Pat. No. 4,085,606; and Cleve et al in U.S. Pat. No. 4,779,440, are supported at ends opposite the extrusion die by a radial flange which engages a support member. These mandrels appear to work well for larger extruded articles, but their life is limited because at the extrusion temperature the mandrels anneal out and become soft after extended use.

This problem is exaggerated for devices designed for micro extrusion of thin walled hollow articles having wall and web thicknesses ranging from 0.020 to 0.012 inches such as would be used in heat exchangers for refrigerators or air conditioning units. It has been found that the frictional heat and heat resulting from a change of phase generated during the extrusion process of these thin walled hollow articles rapidly anneal out the steel mandrel which leads to their premature deterioration or bending.

The use of sintered carbide dies having significantly high softening temperatures is well known in the art, however, the use of sintered carbide mandrels has been limited to relatively large round mandrels. In a circular form, the sintered carbide has a fairly uniform coefficient of thermal expansion. Conversely, however, rectangular mandrels made from sintered carbide have nonuniform coefficients of thermal expansion and will readily fracture in areas of concentrated stresses during the extrusion process, particularly in the region of the radial flange as taught by the prior art. The prior art does not teach or infer any method or structural arrangement which overcomes the problems resulting in the nonuniform coefficient of thermal expansion of rectangular carbide mandrels which would permit the use of carbide mandrels in extrusion devices for making hollow thin walled articles having wall thicknesses less than 0.025 inches.

SUMMARY OF THE PRESENT INVENTION

The invention is a carbide mandrel assembly mountable in an extrusion die apparatus for extruding thin walled multiple aperture conduits. The carbide mandrel assembly consists of a retainer collar mountable in the extrusion die assembly and a carbide mandrel. The retainer collar has a rectangularly-shaped longitudinal slot extending therethrough which faces the extrusion die aperture and is substantially parallel thereto. The carbide mandrel has a rectangularly-shaped holder portion and a mandrel portion. The rectangularly-shaped holder portion is slidably receivable in the longitudinal slot of the retainer collar and the mandrel portion has at least one mandrel element which extends into the extrusion die aperture. Longitudinal guide means are provided for retaining the holder portion of the carbide mandrel in the longitudinal slot.

In the preferred embodiment, the die aperture has a rectangular shape and the mandrel portion of the carbide mandrel has a linear array of micro mandrel elements extending into the rectangular die aperture.

The object of the invention is a mandrel for extruding thin wall conduits which will not soften or bend during the extrusion process.

Another object of the invention is a mandrel made from a sintered carbide having substantially no high stress areas.

Another object of the invention is a rectangular carbide mandrel for producing micro aperture conduits having wall and web thicknesses less than 0.020 inches.

Another object of the invention is a structure for mounting the carbide die in an extrusion die aperture which permits the carbide die to be easily removed or replaced.

These and other objects will become evident from a reading of the detailed description of the invention in conjunction with the drawings.

DETAILED DESCRIPTION OF THE PREFERRED EMBODIMENT

Figure 1:
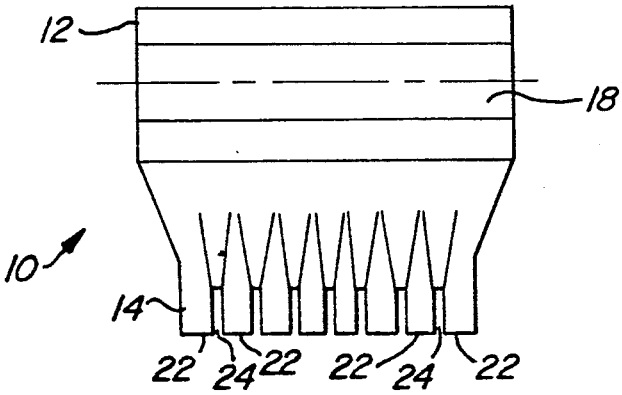
FIGS. 1, 2 and 3 are side, end and bottom views, respectively, of a rectangular carbide mandrel according to a preferred embodiment of the invention.
Figure 2:
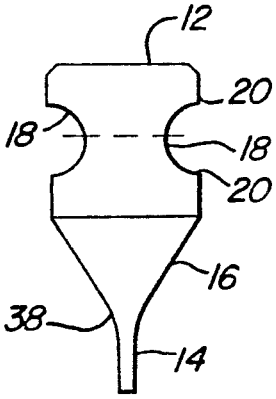
Figure 3:
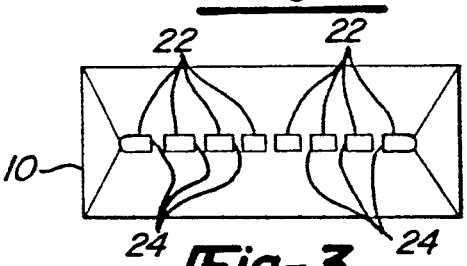
Figure 4:
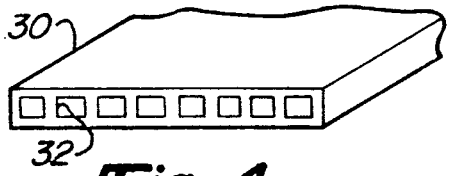
FIG. 4 is a perspective view of an extruded multichannel conduit produced using the carbide mandrel of FIGS. 1, 2 and 3.

The details of a carbide mandrel 10 are shown in FIGS. 1 through 3. The carbide mandrel is designed for extruding a rectangular thin walled extruded multichannel conduit 30, such as shown in FIG. 4, which could be used in a heat exchanger for a refrigerator or air conditioner. Referring back to FIGS. 1 thourgh 3, the carbide mandrel 10 has a generally rectangularly-shaped holder portion 12, a micro mandrel portion 14, and a tapered intermediate portion 16 connecting the holder portion 12 to the micro mandrel portion 14. A pair of longitudinal guideways or recesses 18 are provided on the opposite sides of the holder portion 12. Preferably, these longitudinal recesses 18 have semi-circular cross-sections as shown in FIG. 2; however, they may have different cross-sections as shown in the alternate embodiment of FIGS. 14 and 15. Edges 20 of the longitudinal recesses 18 are rounded to eliminate any sharp corners or edges which could produce concentrated areas of stress.

The micro mandrel portion 14 is rectangular in shape and has an array of micro mandrel elements 22 provided at the end opposite the tapered intermediate portion 16. The array of micro mandrel elements 22 in the illustrated embodiment are linearly disposed along a straight line as shown in FIG. 3. However, the array of micro mandrel elements 22 may consist of two or more rows of micro mandrel elements 22 or the array of micro mandrel elements 22 may be disposed along a curved line, if desired. The size and shape of the individual micro mandrel elements 22 may vary according to the particular needs of the multi-channel conduit to be extruded. In the preferred embodiment shown in FIGS. 1 through 3, each micro mandrel element 22 has a 2.5 mm (0.10 inch) width and a 1.25 mm (0.05 inch) thickness.

Widths of the micro mandrel element may range from 1.0 to 4.0 mm while thickness or height may vary from 0.5 to 2.0 mm.

The individual micro mandrel elements 22 are separated from each other by a plurality of web slots 24 having a width in the range from 0.3 to 0.5 mm (0.012 to 0.018 inches) which produce the internal webs 32 of the multi-channel conduit 30 shown in FIG. 4.

Figure 5:
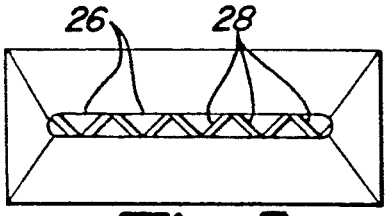
FIG. 5 is a bottom view of an alternate embodiment of the invention in which the micro mandrel elements have a triangular shape.
Figure 6:
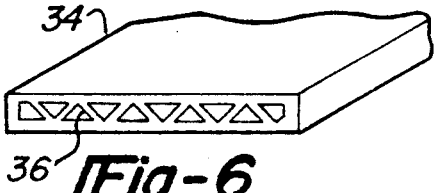
FIG. 6 is a perspective view of an extruded multichannel conduit produced using the carbide mandrel of FIG. 5 having triangularly-shaped micro mandrel elements.

In FIGS. 1 through 3, the individual micro mandrel elements 22 have a rectantular shape, however, they may be round or, as shown in FIG. 5, the individual micro mandrels 26 may have a triangular or trapezoidal shape. In this case, the web slots 28 are angularly disposed relative to the linear extent of the array of micro mandrels 26. The carbide mandrel shown in FIG. 5 will generate a multi-channel conduit 34 in which angled internal webs 36 form triangularly or trapezoidally-shaped channels, as shown in FIG. 6.

A juncture 38 between the tapered intermediate portion 16 and the micro mandrel portion 14 is flared to provide a smooth curved interface between the tapered intermediate portion 16 and the micro mandrel portion 14. This curved interface inhibits the formation of an area of concentrated stress at the junction between the tapered intermediate portion 16 and the micro mandrel portion 14.

Preferably, the carbide mandrel is made from a sintered high temperature carbide, such as a Carmet, grade D-43, manufactured by Carmet of Duncan, S.C.

This sintered carbide material has a softening temperature of approximately 1,400° C. and a Rockwell 88 hardness on the C scale and is an ideal material for the mandrel of an extrusion apparatus used for producing thin walled, multi-channel, rectangularly-shaped as well as circularly-shaped conduits.

Figure 7:
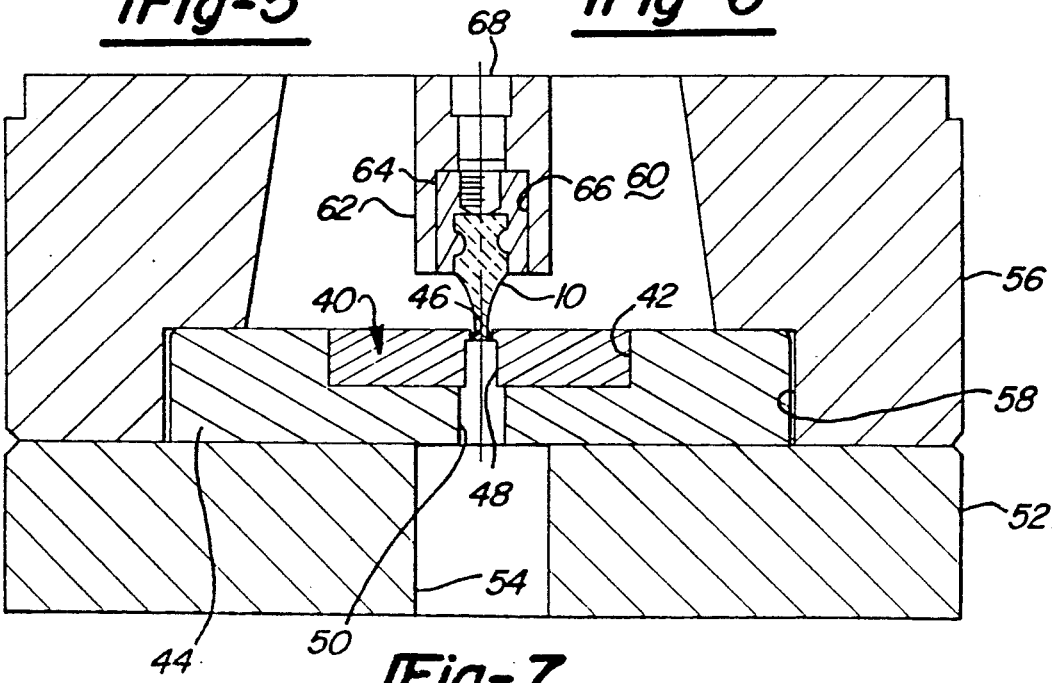
FIG. 7 is a cross-sectional end view of an extrusion die apparatus.
Figure 8:
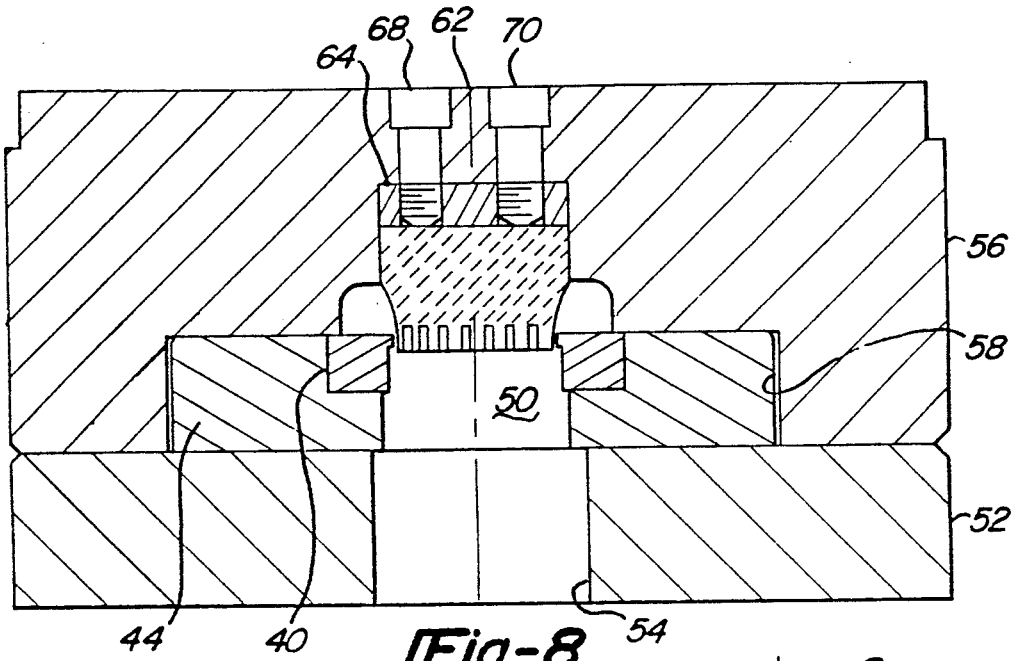
FIG. 8 is a cross-sectional side view of the extrusion die apparatus of FIG. 7.

The details of the extrusion die apparatus embodying the carbide mandrel 10 are shown in FIGS. 7 and 8. The extrusion die apparatus has a female die 40 disposed in a die cavity 42 of a die holder 44. The female die 40 is preferably made from a sintered carbide and has a rectangularly-shaped die aperture 46 conforming to the external cross-sectional dimensions of the multi-channel conduit 34 to be made and a clearance aperture 48 having a cross-section larger than the die aperture 46. The die holder 44 also has a clearance aperture 50 which, in turn, is preferably larger than the clearance aperture 48 which permits the extruded conduit to pass therethrough.

The die holder 44 is mounted in a backer plate 52 using threaded fasteners (not shown). The backer plate 52 also has a clearance aperture 54 which allows the extruded conduit to pass therethrough.

A housing 56 is mounted on the backer plate 52 using conventional fasteners (not shown). The housing 56 has an annular recess 58 in which the female die 40 and the die holder 44 are received and a feed cavity 60 which circumscribes the rectangular die aperture. The feed cavity 60 conducts the material to be extruded to the die aperture 46 of the female die 40. The housing 56 has a diametrically disposed bridge 62 spanning the feed cavity 60 above the female die 40. The bridge 62 preferably is an integral part of the housing 56, as shown, but may be a separate member attached to the housing 56.

Figure 9:
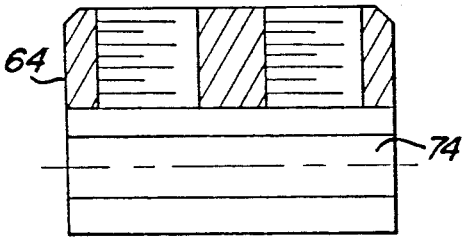
FIG. 9 is a cross-sectional side view of a retainer collar.
Figure 10:
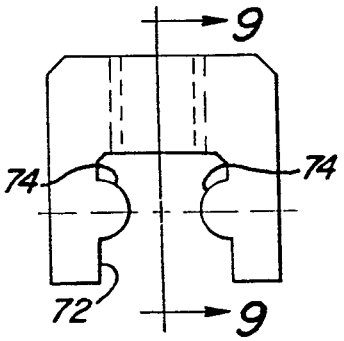
FIG. 10 is an end view of the retainer collar.

A rectangularly-shaped retainer collar 64 is received in a rectangular cavity 66 provided in the bridge 62 above and facing the female die 40 and is secured thereto by threaded fasteners, such as bolts 68 and 70 as shown in FIG. 8. The details of the retainer collar 64 are shown in FIGS. 9 and 10. The retainer collar 64 has a generally rectangular shape and has a longitudinal mandrel receiver slot 72 extending therethrough. A pair of inwardly directed longitudinal ribs 74, which extend generally parallel to the length of the extrusion die aperture 46, extend the length of the longitudinal mandrel receiver slot 72. The longitudinal ribs 74 have a cylindrical outer surface which mates with the longitudinal recesses 18 of the carbide mandrel 10. The carbide mandrel 10 is slidably received in the receiver slot 72 of the retainer collar 64 and is secured against vertical displacement by the engagement of the longitudinal ribs 74 in the longitudinal recesses 18 of the carbide mandrel 10. The end walls of the rectangular cavity 66 provided in the bridge 62 inhibit longitudinal movement of the carbide mandrel 10 in the longitudinal mandrel receiver slot 72 when the retainer collar 64 is secured in the rectangular cavity 66 as shown in FIG. 8. The carbide mandrel 10 is thus held in alignment with the female die 40 with the micro mandrel elements 22 extending into the opening of the die aperture 46.

The first advantage of this type of structural arrangement for mounting the carbide mandrel 10 to the retainer collar 64 is that the areas of stress concentration are minimized, significantly reducing the probability of fracture of the carbide mandrel 10 and the micro mandrel elements 22 during the extrusion process. A second advantage is that the carbide mandrel 10 may be readily removed or replaced.

Figure 11:
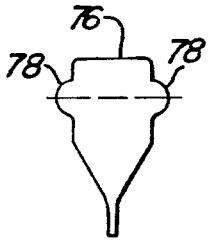
FIGS. 11 and 12 are end and side views, respectively, of a third embodiment of the carbide mandrel.
Figure 12:
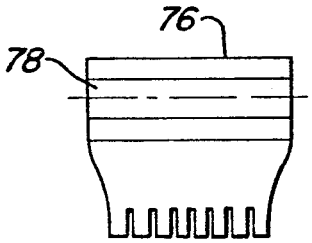
Figure 13:
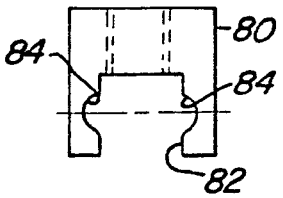
FIG. 13 is an end view of the retainer collar which mates with the third embodiment of the carbide mandrel shown in FIGS. 11 and 12.

Alternate embodiments of the carbide mandrel 10 and the retainer collar 64 are shown in FIGS. 11 through 16. As shown in FIGS. 11, 12 and 13, a carbide mandrel 76 may have a pair of longitudinal ribs 78 on its opposite sides instead of the longitudinal recesses 18 and, as shown in FIG. 13, a longitudinal mandrel slot 82 of a retainer collar 80 has a pair of longitudinal recesses or guideways 84 in which the longitudinal ribs 78 are slidably received.

Figure 14:
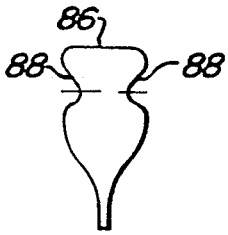
FIGS. 14 and 15 are end and side views, respectively, of a fourth embodiment of the carbide mandrel.
Figure 15:
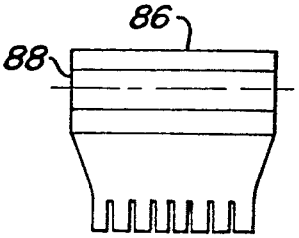
Figure 16:
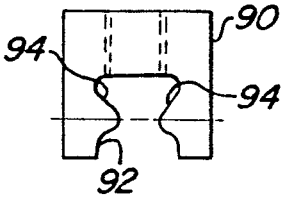
FIGS. 16 is an end view of the retainer collar which mates with the fourth embodiment of the carbide mandrel.

The cross-sectional contours of the longitudinal ribs 78 and the longitudinal recesses or guideways 84 may be semi-circular, as shown, or may be any other type of nonlinear contour known in the art. Preferably, the contours of the longitudinal ribs 78 and the longitudinal recesses or guideways 84 are semi-circular since semi-circular surfaces are relatively easy to machine to close tolerances during the fabrication of the carbide mandrel and its mating retainer collar. However, it is not necessary that the mating recesses and ribs have a semi-circular cross-sectional contour as illustrated in FIGS. 14 and 15. In this embodiment, a carbide mandrel 86 has a pair of longitudinal recesses or guideways 88, the cross-section of which is non-circular. A rectangularly-shaped retainer collar 90, as shown in FIG. 16, has a pair of face-to-face longitudinal ribs 94 projecting inwardly from the side walls of a longitudinal mandrel receiver slot 92. The longitudinal ribs 94 have a cross-sectional contour which mates with the cross-sectional contour of the longitudinal recesses 88. As in the previous embodiments, the carbide mandrel 86 is slidably received in the longitudinal mandrel slot 92 of the retainer collar. The retainer collars 80 and 90 and their associated carbide mandrels 76 and 86, respectively, are mountable in the rectangular cavity 66 of the housing 56 using the bolts 68 and 70 in the same manner the retainer collar 64 and carbide mandrel 10 are mounted in the rectangular cavity 66, as shown in FIG. 7.

It is not intended that the invention be limited to the specific embodiments shown in the drawings or described in the detailed description of the invention. It is recognized that those skilled in the art may conceive and develop comparable structures within the scope of the invention as set forth in the appended claims.

What is claimed is:

1. A carbide mandrel for an extrusion die apparatus comprising:

a rectangular holder portion having substantially parallel sides, each side of said substantially parallel sides having a longitudinal guideway extending the length of said rectangular holder portion, said longitudinal guideway having a non-planar contoured cross-section;

a mandrel portion having at least one mandrel element extending therefrom in a direction away from said rectangular holder portion; and a tapered intermediate portion connecting said mandrel portion to said rectangular holder portion.

2. The carbide mandrel of claim 1, wherein said longitudinal guideway is a longitudinal recessed guideway provided in each side of said rectangular holder portion.

3. The carbide mandrel of claim 2, wherein said non-planar contoured cross-section is a semi-circular cross-section.

4. The carbide mandrel of claim 1, wherein said longitudinal guideway is a longitudinal rib protruding from each side of said rectangular holder portion.

5. The carbide mandrel of claim 4, wherein said longitudinal ribs have a non-planar contoured cross-section.

6. The carbide mandrel of claim 5 wherein said non-planar contoured cross-section is a semi-circular cross-section.

7. The carbide mandrel of claim 5 wherein said non-planar contoured cross-section is an arcuate cross-section.

8. The carbide mandrel of claim 1, wherein said at least one mandrel element comprises an array of micro mandrel elements.

9. The carbide mandrel of claim 8, wherein said array of micro mandrel elements is a linear array of micro mandrel elements.

10. The carbide mandrel of claim 9, wherein each micro mandrel element of said linear array of micro mandrel elements is separated from each other by a web slot.

11. The carbide mandrel of claim 10, wherein each micro mandrel element of said linear array of micro mandrel elements has a generally rectangular cross-section and said web slots are disposed normal to the length of said linear array of micro mandrel elements.

12. The carbide mandrel of claim 11, wherein each micro mandrel element of said linear array of micro mandrel elements has a width ranging from 1.0 to 4.0 mm and a thickness ranging from 0.5 to 2.0 mm.

13. The carbide mandrel of claim 12, wherein said web slots have a width ranging from 0.3 to 0.5 mm.

14. The carbide mandrel of claim 10, wherein each carbide micro element of said linear array of micro mandrel elements has a generally triangular cross-section and wherein each adjacent pair of micro mandrel elements is separated by an angularly disposed web slot.

15. The carbide mandrel of claim 14, wherein each carbide micro mandrel element of said linear array of micro mandrel elements has a base ranging from 1.0 to 4.0 mm and a height ranging from 0.5 to 2.0 mm.

16. The carbide mandrel of claim 14, wherein said angularly disposed web slot has a width ranging from 0.3 to 0.5 mm.

17. The carbide mandrel of claim 1, wherein said carbide mandrel is a sintered carbide mandrel.

18. The carbide mandrel of claim 1 wherein said non-planar contoured cross-section is a semi-circular cross-section.

19. The carbide mandrel of claim 1 wherein said non-planar contoured cross-section is an arcuate cross-section.

20. A carbide mandrel assembly mountable in an extrusion die apparatus having an extrusion die which has an extrusion die aperture, said carbide mandrel assembly comprising:

a retainer collar mountable to said extrusion die apparatus, said retainer collar having a rectangularly-shaped longitudinal slot extending therethrough, said rectangularly-shaped longitudinal slot facing said extrusion die aperture and substantially parallel thereto;

a carbide mandrel having a rectangularly-shaped holder portion and a mandrel portion, said rectangularly-shaped holder portion being received within said rectangularly-shaped longitudinal slot of said retainer collar and said mandrel portion having at least one mandrel element which extends into said extrusion die aperture; and longitudinal gruide means for retaining said rectangularly-shaped holder portion of said carbide mandrel in said rectangularly-shaped longitudinal slot of said retainer collar, said longitudinal guide means having a non-planar contoured cross-section.

21. The carbide mandrel assembly of claim 20, wherein said longitudinal guide means comprises a longitudinal recessed guideway provided an opposite sides of said rectangularly-shaped holder portion of said carbide mandrel and a pair of mating longitudinal ribs protruding from the sides of said rectangularly-shaped longitudinal slot into said longitudinal recessed guideways, each one of said pair of mating longitudinal ribs being slidably received in said longitudinal recessed guideway provided on opposite sides of said holder portion of said carbide mandrel in a longitudinal direction and prohibiting displacement of said carbide mandrel relative to said retainer collar in a direction normal to said longitudinal recessed guideways and said pair of mating longitudinal ribs.

22. The carbide mandrel assembly of claim 21, wherein said longitudinal recessed guideway and said pair of mating longitudinal ribs have mating non-planar contoured cross-sections.

23. The carbide mandrel assembly of claim 22 wherein said non-planar contoured cross-sections are semi-circular cross-sections.

24. The carbide mandrel assembly of claim 22 wherein said non-planar contoured cross-sections are arcuate cross-sections.

25. The carbide mandrel assembly of claim 20, wherein said longitudinal guide means comprises a pair of facing longitudinal recessed guideways provided in the sides of said rectangularly-shaped longitudinal slot and a pair of longitudinal ribs provided on opposite sides of said rectangularly-shaped holder portion of said carbide mandrel and slidably engaged with said longitudinal recessed guideways, said longitudinal recessed guideways and said pair of mating longitudinal ribs permitting said rectangularly-shaped holder portion of said carbide mandrel to be slidably inserted into said rectangularly-shaped longitudinal slot in a longitudinal direction to said carbide mandrel and prohibiting displacement of said carbide mandrel relative to said retainer collar in a direction normal to said longitudinal recessed guideways and said pair of mating longitudinal ribs.

26. The carbide mandrel assembly of claim 25, wherein said longitudinal recessed guideways and said pair of longitudinal ribs have a non-planar contoured cross-section.

27. The carbide mandrel assembly of claim 26 wherein said non-planar contoured cross-section is a semi-circular cross-section.

28. The carbide mandrel assembly of claim 26 wherein said non-planar contoured cross-section is an arcuate cross-section.

29. The carbide mandrel assembly of claim 26 wherein said at least one mandrel element comprises of micro mandrel elements.

30. The carbide mandrel assembly of claim 29 wherein said array of micro mandrel elements is a linear array of micro mandrel elements, each micro mandrel element in said array of micro mandrel elements being separated from an adjacent micro mandrel element by a web slot.

31. The carbide mandrel assembly of claim 30 wherein said web slot has a width ranging from 0.3 to 0.5mm.

32. The carbide mandrel assembly of claim 30 wherein each micro mandrel element of said linear array of micro mandrel elements has a generally rectangular cross-section.

33. The carbide mandrel assembly of claim 32 wherein each said micro mandrel element has a width ranging from 1.0 to 4.0mm and a thickness ranging from 0.5 to 2.0mm.

34. The carbide mandrel assembly of claim 30 wherein each micro mandrel element has a generally triangular cross-section.

35. The carbide mandrel assembly of claim 34 wherein each said micro mandrel element has a base ranging from 1.0 to 4.0mm and a height ranging from 0.5 to 2.0mm.

36. The carbide mandrel assembly of claim 20 wherein said carbide mandrel is a sintered carbide mandrel.

37. An extrusion die apparatus comprising:

a backer plate having a centrally disposed first clearance aperture;

a die holder mounted to said backer plate, said die holder having a second clearance aperture aligned with said first clearance aperture, and an aligned die cavity;

a die having a die aperture mounted in said die cavity with said die aperture aligned with said first and second clearance apertures;

a housing attached to said backer plate, said housing having a feed chamber passing therethrough circumscribing said die aperture and a bridge portion spatially separated from said die, said bridge portion spanning said feed chamber and having a retainer cavity provided therein facing said die aperture;

a retainer collar mounted within said retainer cavity, said retainer collar having a longitudinally-disposed mandrel slot facing said die;

means for securing said retainer collar in said retainer cavity;

a carbide mandrel received within said longitudinally-disposed mandrel slot, said carbide mandrel having at least one mandrel element which extends into said die aperture when said carbide mandrel is received in said longitudinally-disposed mandrel slot and said retainer collar is mounted in said retainer cavity; and longitudinal guideway means for retaining said carbide mandrel in said longitudinally-disposed mandrel slot, said longitudinal guideway means having a non-planar contoured cross-section.

38. The extrusion die apparatus of claim 37 wherein said non-planar contoured cross-section is a semi-circular cross-section.

39. The extrusion die apparatus of claim 37 wherein said non-planar contoured cross-section is an arcuate cross-section.

40. The extrusion die apparatus of claim 37, wherein said longitudinal guideway means comprises a pair of recessed longitudinal guideways provided on opposite sides of said carbide mandrel and a complementary pair of longitudinal ribs protruding from the opposing sides of said longitudinally-disposed mandrel slot, said longitudinal guideways being received in said longitudinally-disposed mandrel slot in a longitudinal direction.

41. The extrusion die apparatus of claim 37 wherein said longitudinal guideway means comprises a pair of recessed longitudinal guideways provided in the opposing walls of said longitudinally-disposed mandrel slot and a complementary pair of longitudinal ribs protruding from opposite sides of said carbide mandrel into said recessed longitudinal guideways which permit said carbide mandrel to be slidably received in said longitudinally-disposed mandrel slot in a longitudinal direction.

42. The extrusion die apparatus of claim 41 wherein said non-planar contoured cross-section is a semi-circular cross-section.

43. The extrusion die apparatus of claim 41 wherein said non-planar contoured cross-section is an arcuate cross-section.

44. The extrusion die apparatus of claim 37 wherein said at least one mandrel element is an array of micro mandrel elements.

45. The extrusion die apparatus of claim 44 wherein said die aperture is a rectangular die aperture, said array of micro mandrel elements is a linear array of micro mandrel elements received within said rectangular die aperture.

46. The extrusion die apparatus of claim 45 wherein each said micro mandrel element in said linear array of micro mandrel elements is separated from each adjacent micro mandrel element by a web slot.

47. The extrusion die apparatus of claim 46 wherein each said micro mandrel element has a rectangular cross-section having a width ranging from 1.0 to 4.0mm and a thickness of 0.5 to 2.0mm and wherein the width of said web slots range from 0.3 to 0.5mm.

48. The extrusion die apparatus of claim 46 wherein each said micro mandrel element has a triangular cross-section separated by diagonally disposed web slots.

49. The extrusion die apparatus of claim 48 wherein each said micro mandrel element has a cross-sectional base length ranging from 1.0 to 4.0mm and a cross-sectional height ranging from 0.5 to 2.0mm.

50. The extrusion die apparatus of claim 37 wherein said carbide mandrel is a sintered carbide mandrel.

* * * * *

UNITED STATES PATENT AND TRADEMARK OFFICE

CERTIFICATE OF CORRECTION

PATENT NO. : 5,131,253

DATED : July 21, 1992

INVENTOR(S) : Hopkins

It is certified that error appears in the above-identified patent and that said Letters Patent is hereby corrected as shown below:

Column 3, line 33, delete "rectantular" and insert ---- rectangular ----.

Column 6, line 13, after "micro" insert ---- mandrel ----."

Column 6, line 49, delete "gruide" and insert ---- guide ----.

Column 6, line 56, delete "an" and insert ---- on ----.

Column 7, line 39, before "of" insert ---- an array ----.

Signed and Sealed this

Seventeenth Day of August, 1993

Bruce Lehman

*Attest:*

BRUCE LEHMAN

*Attesting Officer*

*Commissioner of Patents and Trademarks*